US005832562A

United States Patent [19]

Luca

[11] Patent Number: 5,832,562

[45] Date of Patent: Nov. 10, 1998

[54] DOOR CLOSER

[76] Inventor: Valentin Luca, 125 Katona Dr., Unit 4A6, Fairfield, Conn. 06430

[21] Appl. No.: 984,270

[22] Filed: Dec. 3, 1997

Related U.S. Application Data

[63] Continuation-in-part of Ser. No. 555,730, Nov. 9, 1995, which is a continuation-in-part of Ser. No. 547,921, Oct. 25, 1995, Pat. No. 5,630,248.

[51] Int. Cl.[6] ..... E05F 1/00; E05F 5/02

[52] U.S. Cl. ..... 16/71; 16/49; 16/66; 16/82; 16/DIG. 10

[58] Field of Search ..... 16/71, 72, 82, 16/84, 85, 49, 66, DIG. 10; 292/DIG. 4, 306, 278, 262

[56] References Cited

U.S. PATENT DOCUMENTS

| | | |
|---|---|---|
| 3,105,264 | 10/1963 | Truhon . |
| 3,284,841 | 11/1966 | Patriquin . |
| 3,593,367 | 7/1971 | Waldo . |
| 4,194,264 | 3/1980 | Stoffregen . |
| 4,382,311 | 5/1983 | Watts . |
| 4,777,698 | 10/1988 | Lord . |
| 4,815,163 | 3/1989 | Simmons . |
| 4,878,265 | 11/1989 | Nesbitt . |
| 4,894,883 | 1/1990 | Fleischhauer . |
| 4,920,609 | 5/1990 | Lin . |
| 5,048,150 | 9/1991 | Guerin . |
| 5,083,342 | 1/1992 | Klinefelter . |
| 5,157,806 | 10/1992 | Waritian . |
| 5,293,666 | 3/1994 | Armstrong . |
| 5,630,248 | 5/1997 | Luca . |

*Primary Examiner*—Chuck Y. Mah

*Attorney, Agent, or Firm*—Fattibene and Fattibene; Arthur T. Fattibene; Paul A. Fattibene

[57] ABSTRACT

This invention is directed to a door closer which is rendered optionally operative to effect either a controlled closing of the door upon opening or to automatically latch or arrest the door in the open position as may be desired. This is attained by a closer housing having a cylinder chamber and a connected latching chamber in which a piston is reciprocally mounted in the cylinder chamber which is biased by a compression spring toward the closed position. The piston rod connected to the piston extends through the end of the latching chamber and a latching member and an associated recoil spring is slidably disposed on the piston rod within the latching chamber. An arming device extends into the latching chamber which is shiftable between an armed position and an unarmed position. The arrangement is such that in the unarmed position, the door closer operates in a normal manner and when the arming mechanism is shifted to an armed position, the closer functions to automatically latch the door in the opened position. Unlatching is effected by displacing the door slightly toward opening position whereby the recoil spring effects the unlatching of the door, and whereby the door under the force of the compression spring is closed.

25 Claims, 6 Drawing Sheets

DOOR CLOSER

RELATED APPLICATIONS

This application relates to and is a continuation in part application of my co-pending application Ser. No. 08/555,730 filed Nov. 9, 1995 for Door Closers With Automatic Latching And/Or Delayed Action, which is a continuation-in-part application of my application Ser. No. 547,921 filed Oct. 25, 1995, now U.S. Pat. No. 5,630,248 granted May 20, 1997.

This application also relates to Disclosure Document No. 420001 filed May 23, 1997.

FIELD OF THE INVENTION

This invention relates generally to door closers, and more specifically to a door closer which is rendered optionally operative to effect either a controlled closing of a door upon opening or to automatically latch or arrest a door in an open position as may be required.

PROBLEM AND PRIOR ART

Various types of door closers are known, as evidenced by U.S. Pat. Nos. 3,105,264; 3,284,841; 3,593,367; 4,194,264; 4,382,311; 4,777,698; 4,815,163; 4,878,265; 4,894,883; 4,920,609; 5,048,150; 5,083,342; 5,157,806 and 5,293,666. Generally, such door closers include a cylinder having a piston with a connected piston rod reciprocally displaced within the cylinder which is normally biased by a compression spring. With the opposed ends of the cylinder and the piston rod, respectively, suitably connected between a door frame and its door, the opening of the door causes the piston to be rectilinearly displaced within the cylinder whereby the connected piston rod is extended beyond the end of the cylinder, thereby compressing the spring. The compression spring, acting on the piston in its compressed state, normally functions to return the door to its closed position as the door is released upon the opening thereof.

However, it is frequently desirable to have a door fitted with such door closers to be latched in the opened position. Heretofore, latching of the door in an opened position was attained generally by a latching washer which was required to be manually shiftable along the extended portion of the piston rod G to block or arrest the return of the piston rod to retain the door in the open position. To operate such latching washer generally required the use of a person's two hands. One hand was required for maintaining the door in the opened position, while the other hand was required to shift the latching washer along the extended piston rod to block or arrest the piston rod in the extended position to prevent the door from closing. It has been observed that with such types of door closer latching arrangements, considerable difficulty is frequently encountered in attempting to latch a door in the open position when one is carrying packages, and/or has only one hand free to open and latch a door in an open position. Also, in unlatching the door, the operator is required to apply a force on the door to open the door further to release the forces acting on the latching washer and then manually slide the latching washer along the piston rod to return the same to its inoperative or unlatching position.

Door closers with more convenient latches have been proposed in the prior art. However, such known door closers have not appeared to have gained commercial acceptance for the reason that they are generally more complicated in structure than the manual latching closer above described and, therefore, much more expensive and difficult to manufacture and/or assemble.

SUMMARY OF THE INVENTION

An object of this invention is to provide a door closer which can be selectively operated to function like a conventional door closer to effect automatic closing of a door upon the opening door on the release thereof, or at the user's option, to automatically latch the door in the opened position.

Another object is to provide a door closer with an arming mechanism which, when actuated, will cause automatic latching of a door in an open position.

Another object is to provide a door closer with an arming mechanism and an associated latching washer confined within a relatively small linear space adjacent the end of the cylinder through which the piston rod extends.

Another object is to provide a door closer with a dampener operatively associated with the arming mechanism to minimize any shock imparted upon the door closer in latching the door in the opened position and thereby preclude any unintentional unlatching of the door.

Another object is to provide a door closer with an arming mechanism that is retained in the armed position and which arming mechanism is automatically repositioned or reset to an unarmed position upon the latching of the door.

Another object is to provide a door closer with an arming mechanism having a readily releasable retaining device whereby the arming mechanism is retained in the unarmed position so that upon the release thereof, the arming device is shifted to the armed position to effect automatic latching of the door and which is automatically repositioned or reset to the initial retained, unarmed position upon the latching of the door in an opened position.

Another object of this invention is to provide a door closer with an arming mechanism and associated latching device whereby a door latched in the open position is readily released by simply imparting a slight displacement of the door toward the opening position.

Another object of the invention is to provide a door closer which can be selectively operated as a conventional door closer or to automatically arrest the closing of the door so as to latch the door in an open position that is relatively simple in construction, positive in operation, and inexpensive to fabricate.

The foregoing objects and other features and advantages of the invention are attained by a door closer that includes a housing defining a cylinder chamber having reciprocally mounted therein a piston and a connected piston rod that extends through and beyond an end wall of the housing. A compression spring is disposed within the cylinder chamber between the piston and an end wall or partition wall defining the cylinder chamber for normally maintaining a spring bias on the piston. The extended end of the piston rod and the opposed or other end of the cylinder chamber are suitably connected to the door and/or door frame by suitable brackets so that when the associated door is moved toward an open position, the piston rod is extended to compress the spring biasing the piston. Spaced from the partition wall defining the cylinder chamber against which one end of the compression spring abuts is an outer end wall to define a relatively short linear space between the outer end wall and the partition wall. Disposed within the linear space defined and arranged to freely slide along the piston rod within the space defined is a latching member. A compression or recoil spring is disposed about the piston rod between the latching member and the partition wall within the linear space.

In accordance with this invention, there is associated with the latching member an arming device which can be selectively positioned between an armed position and an unarmed position. The arming device, when positioned in the unarmed position, allows the door closer to operate in a conventional manner, i.e. upon the opening of the door, the piston rod is extended to effect the compression of the spring biasing the piston, so that upon releasing the door after opening causes the door to be automatically closed by the compression spring acting on the piston to normally bias the door toward the closed position.

When the arming mechanism is manually shifted to its armed position, the arrangement is such that the releasing of the door after opening automatically causes the arming mechanism to actuate the latching member riding on the piston rod, upon the movement of the piston rod toward the door closing position, to arrest the piston rod and prevent the door from closing. The arrangement is such that as the latching member latches or arrests the retraction of the piston rod, the arming mechanism is automatically reset to its unarmed position and the recoil spring compressed between the latching member and the partition for maintaining a spring bias on the latching member in the latched position. The door is thus maintained in the latched or open position until one desires to close the door.

Unlatching of the latching member to release the piston rod to effect the closing of the door is attained simply by effecting a slight displacement of the door toward its opening position, whereby the bias of the recoil spring acting on the latching member causes the latching member to release the piston rod. Upon the unlatching of the piston rod, the force of the compression spring acting on the piston effects the retraction of the piston rod and the corresponding closing of the door. As the arming mechanism was automatically reset upon the latching of the door in an opened position, it has been made readied to be again rearmed at the will of the user.

In the variously illustrated forms of this invention, the arming mechanism may include a dampener to minimize any shock imposed upon the arming mechanism upon the closing of the door and to prevent any accidental unlatching due to any after or reverse shocking. A suitable friction arrangement is also provided to maintain the arming mechanism in either its armed or unarmed position. In accordance with this invention, the arming mechanism may take various forms which are similar in function to produce essentially the same results as will more particularly described in the following detailed description.

This invention provides a door closer with the added convenience whereby a person may optionally set the arming mechanism so that the door will be automatically latched in an open door position without the necessity of moving a latching member along the extended piston rod in order to arrest it to prevent closing. The door closer of this invention, when armed, will permit the door to be automatically latched open when the opening force imparted on the door is released, and whereby the door can be readily unlatched by imparting a subsequent slight displacement of the door toward the opening direction. The closer assembly permits the latching to occur anywhere along the stroke of the door closer at the will of the operator.

IN THE DRAWINGS

DETAILED DESCRIPTION

Figure 1:
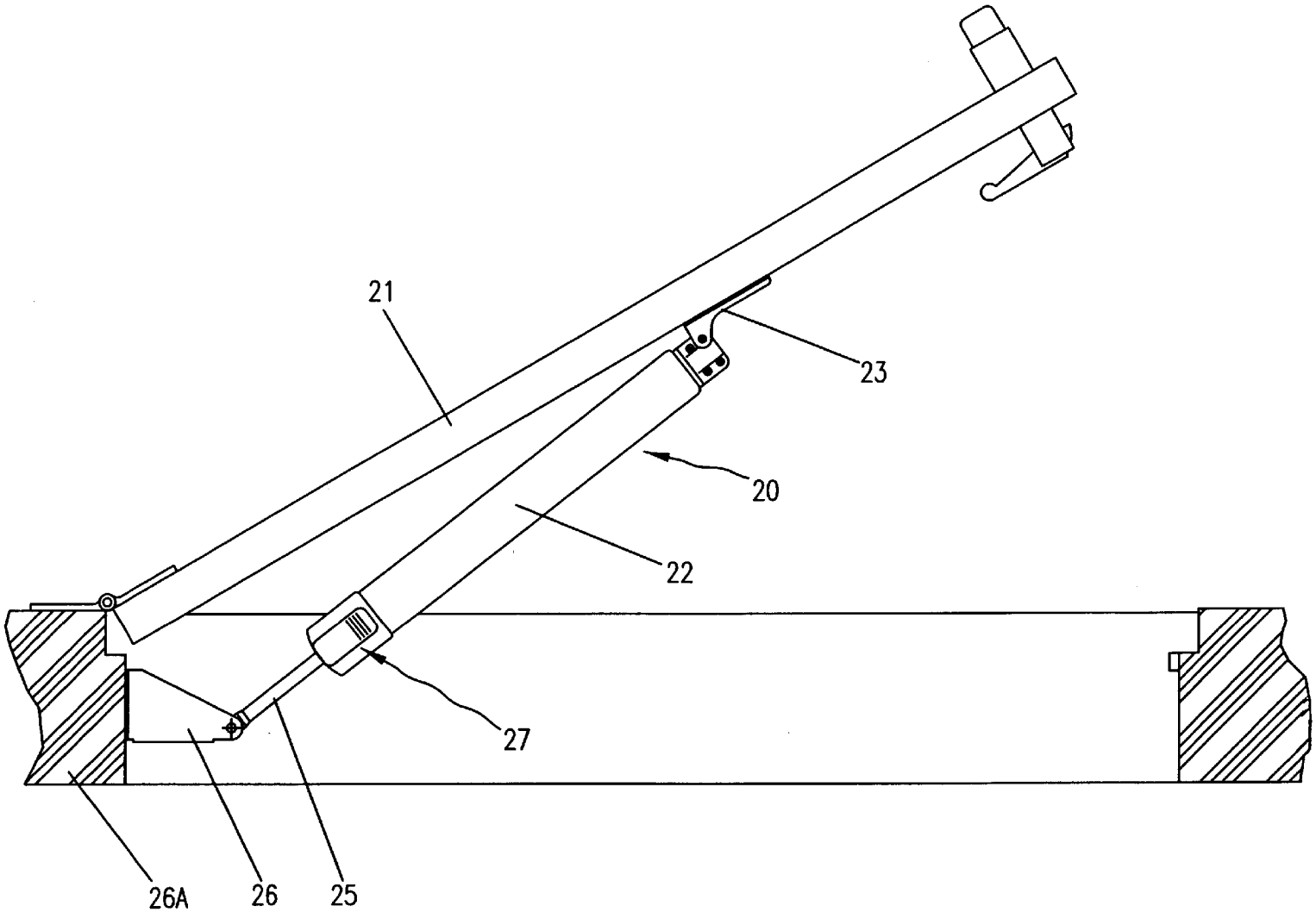
FIG. 1 is a plan view of a door closer embodying the invention operatively connected to a door and its associated door frame.

FIG. 1 illustrates a door closer 20 embodying the present invention as applied to a door 21. The door closer 20 includes a housing or cylinder 22 having one end pivotally connected to a bracket 23 which is suitably connected to the door 21. A piston is reciprocally disposed within the cylinder 22 to which a piston rod 25 is connected. The free end of the piston rod 25 is pivotally connected to a bracket 26 which is secured to the door frame 26A. As will hereinafter be described, the door closer 20 is provided with an arming mechanism 27 which will permit the door closer to be selectively operated to either allow the door to close upon one's entering; or optionally to automatically latch the door 21 is an opened position, as shown in FIG. 1, at the will of the operator.

Figure 3:
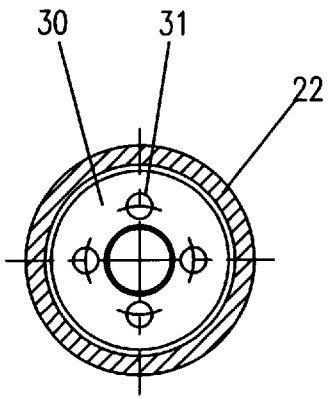
FIG. 3 is a sectional view taken along line 3—3 on FIG. 2.
Figure 2:
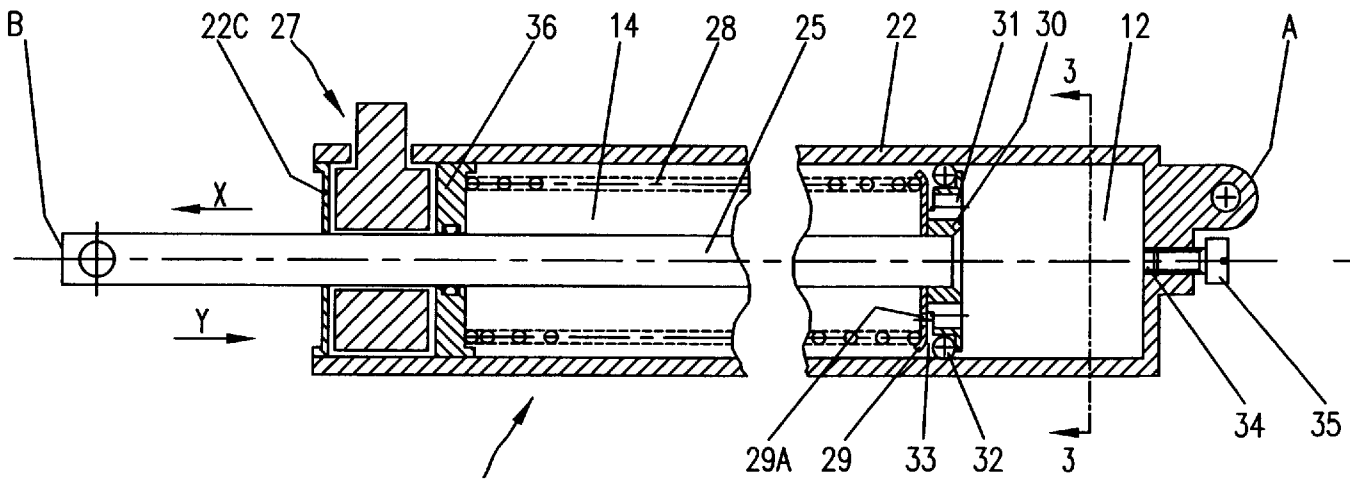
FIG. 2 is a side sectional view of a door closer embodying the invention having portions illustrated schematically.

FIG. 2 is a longitudinal cross-sectional view through a door closer 20 showing the main feature means which are common to various embodiments hereinafter described. The ends "A" and "B" are attached by means of brackets to the door and door's frame respectively. A compression coil spring 28 is enclosed in the cylinder 22 and transmits its force through a washer 29 which is pushing against the piston 30 connected to the piston rod 25. The arrangement is such that the movement of the piston rod 25 extending outwardly of the cylinder effects the opening stroke and the movement of the piston rod 25 inwardly or retracting into the cylinder effects the closing stroke. The cylinder 22 may contain a gas or liquid which is used to slow down and smooth the closing motion. Means in the form of metering holes 31 in the piston and holes 29A in the washer 29 provide a differential dampening effect, meaning that, during the movement of the piston 30, the displaced fluid will encounter more resistance when crossing from the chamber 12 to the chamber 14 (closing stroke) than when crossing from the chamber 14 to chamber 12 (opening stroke). A sealing means, shown as O-ring 32, is trapped between the washer 29 and the piston 30 and leans against the washer 29, providing an essentially good sealing during the closing stroke. During the opening stroke, the O-ring 32 leans against the piston 30 allowing the fluid to pass through clearance 33 provided between the washer 29 and the piston 30 and through a plurality of holes 31 provided in the piston 30, said holes 31 being shown as four in number in FIG. 3. In the case the fluid cannot be wasted, the cylinder is adequately sealed and the fluid flows between chamber 12 to chamber 14 through one or a plurality flow metering holes 29A provided in the washer 29. In the case when the fluid is air, the chamber 14 is not essentially sealed and, during the closing stroke, the air from the chamber 12 flows out through an exhaust hole 34 provided with a metering screw 35 which can be of a tapered type and serves as an adjusting means.

The door closer 20 in FIG. 2 is provided with an arming and latching mechanism 27 schematically shown to effect automatic latching. As seen in FIG. 2, the cylinder 22 is provided with an intermediate or partition wall 36, against which the compression spring 28 abuts. The partition wall 36 is slightly spaced linearly from the cylinder end wall 22C. Disposed within the space defined between the partition wall 36 and the cylinder wall 22C is the arming and latching means 27, as hereinafter described.

The figures of this invention show sealing means for fluid that cannot be wasted but, for simplicity, no description of these sealing means is necessary unless essential for understanding of the operating principles of the door closers disclosed herein. It is also understood that, in the case of fluid being air, some sealing means are not necessary.

Figures 4, 4H:
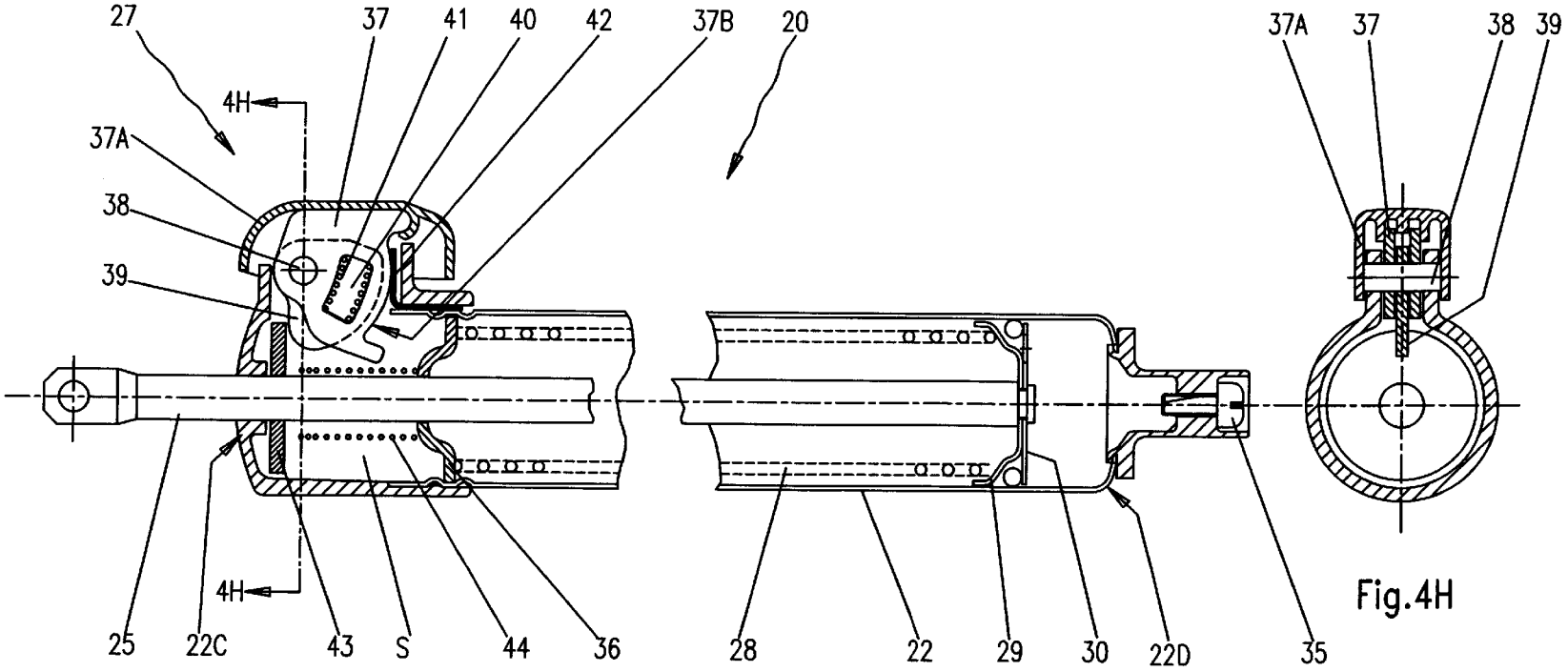
FIG. 4 is a sectional side view of a door closer embodying one form of the invention wherein the parts are shown in the armed position.
FIG. 4H is a sectional view taken along line 4H—4H on FIG. 4.

FIG. 4 illustrates one embodiment of a door closer 20 in accordance with this invention. As shown therein, the door closer 20 includes a housing having a cylinder 22 provided with a piston 30 and a connected piston rod 25. One end 22D of the cylinder 22 may be provided with a metering valve or screw 35 as hereinbefore described. Disposed intermediate of the housing between end wall 22C and 22D of the housing is an intermediate or partition wall 36. The partition wall 36 and end wall 22D defines therebetween the cylinder or piston chamber. A compression spring 28 for maintaining the piston 30 under a spring bias is interposed between the partition wall 36 and the piston washer 29. As shown, the partition or intermediate wall 36 is linearly spaced from the housing end wall 22C a short distance relative to the overall length of the housing and defines therebetween space or chamber S for housing the arming mechanism, the latching member or washer, and the recoil spring as hereinafter described. The arrangement is such that the piston rod 25 extends through the intermediate or partition wall 36 and end wall 22C.

In the space S defined between the partition wall 36 and end wall 22C of the housing, there is disposed the arming and latching mechanism 27 of the present invention. While the piston chamber and the latching chamber are housed within a common housing, the piston chamber and latching chamber may comprise separate components which may be axially connected end to end.

In the embodiment of FIG. 4, the arming mechanism includes lever 37 which is pivotally mounted about a pivot 38 to a fixed portion of the cylinder 22. Connected to the upper end of the lever 37 is a button or head 37A by which a person may arm the arming mechanism 27 as will be hereinafter described.

As best seen in FIG. 4H, the arming lever 37 is bifurcated or formed of a pair of spaced apart members dependingly connected to the head 37A. Disposed within the bifurcated portion of lever 37 is a trigger 39, that is independently pivoted about pivot 38 so that the trigger 39 may pivot independently of the arming lever 37.

As shown in FIG. 4, the arming lever 37 and the trigger 39 are provided with aligned openings or windows 40 defining a cage for containing a spring 41. The arrangement described is such that when the arming lever 37 is pivoted from an unarmed to an armed position, as will be hereinafter described, the trigger 39 is pivoted in unison therewith. When the trigger 39 is pivoted relative to the arming lever 37, the spring 41 is compressed to absorb the shock imposed upon the mechanism, as will be hereinafter described. The spring 41 also absorbs any after or reverse shocking action imparted on the arming device. The arming lever 37 is provided with a cam edge 37B arranged to bear against a friction means which is illustrated as a flat spring 42, fixed to the cylinder. The friction force imparted by the flat spring 42 on the cam surface 37B of the arming lever 37 is sufficient to frictionally create a reaction force to allow the latching washer 43 to latch and to maintain the arming lever 37 in the armed or unarmed position.

The latching means operatively associated with the arming lever 37 comprises a latching member, shown as a washer 43 loosely mounted on the piston rod 25 within space S defined between the partition wall 36 and the cylinder end wall 22C. Disposed about the piston rod 25 within space S is a recoil spring 44. The recoil spring 44 is disposed about the piston rod 25 between the latching washer 43 and the partition wall 36.

Figure 4A:
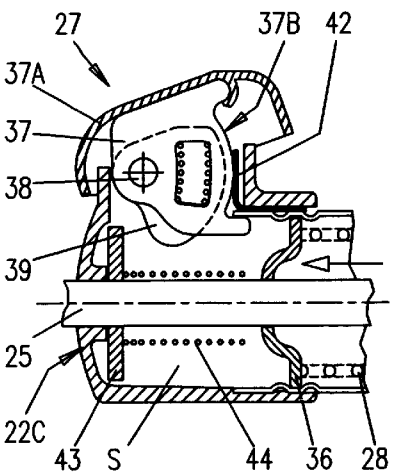
FIG. 4A is a fragmentary sectional side view of FIG. 4 illustrating the parts in an unarmed position as the piston rod is being extended to a door opening position.
Figure 4B:
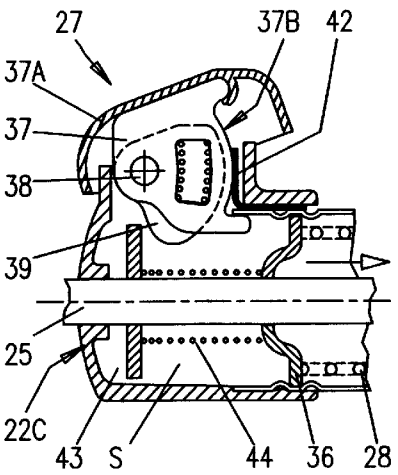
FIG. 4B is a fragmentary sectional side view similar to FIG. 4A in an unarmed position as the piston rod is being retracted to a door closing position.

Referring to FIGS. 4A–4G, the operation of the door closer 20 illustrated in FIG. 4 is as follows:

When the door closer 20 is in an unarmed position as shown in FIGS. 4A and 4B, the door closer operates to effect the opening and closing of the door without effecting the arresting of the piston rod 25 in either the opening or closing of the door. As shown in FIG. 4A, when the piston rod 28 is extended or moved to the left, as indicated by the arrow as the door is moving toward an opening position, the locking washer 43 and associated recoil spring 44 will normally ride with the piston rod 25 toward the end wall 22C. The displacement of the piston 30 toward the door opened position causes the compression spring 28 to compress. Upon the release of the door, the compression spring 28 will normally bias the piston 30 to the right, as indicated in FIG. 4B, to effect the closing of the door. As the piston rod 25 is moved toward the closing door position as shown in FIG. 4B, the locking washer 43 and associated recoil spring 44 will ride with the piston rod 28 to the right until the end of the recoil spring 44 engages the partition or intermediate wall 36. See FIG. 4B. Thus, with the arming mechanism 27 in the unarmed position as shown in FIGS. 4A and 4B, the door, when opened, will be automatically returned to its normally closed position in a gradual controlled manner as a conventional door closer is intended to operate.

However, with the door closer 20 embodying the present invention, the user has the option of setting the door closer 20 so that upon opening of the door, the door will automatically latch in the opened position as soon as the door is released by the user. This is an advantageous feature in that a user, with his or her hands full, as when carrying packages, can arm the door closer in a simple and effective manner so that as the user pushes through the door, the door will automatically latch in the open position immediately upon the release thereof without any further effort on the part of the user. In the latched position of the door, one is free to make multiple passes in and out without requiring the opening and closing of the door on each pass.

Figure 4C:
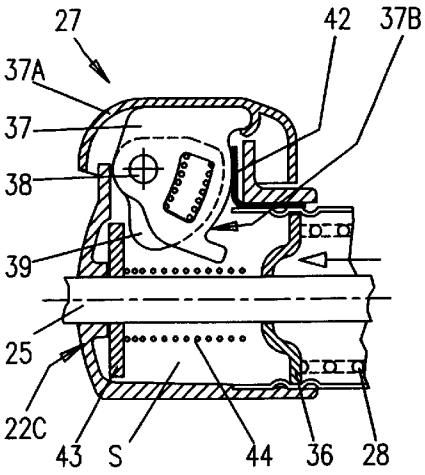
FIG. 4C is a view similar to FIG. 4A illustrating the parts in an armed position as the piston rod is being extended toward a door opening position.

Referring to FIGS. 4C, 4D, 4E and 4F, setting the closer to automatic latching is attained simply by the user setting the arming mechanism 27 to an armed position at any point during the opening or closing of the door. This is attained in the embodiment of FIG. 4 simply by the user pressing on the actuator button 37A which causes the arming lever 37 and associated trigger 39 to be pivoted in unison clockwise about pivot 38 to effect the arming of the closer 20. This can be readily accomplished by the user even when carrying packages as the arming mechanism can be tripped by "elbowing" the arming button 37 to the armed position as shown in FIG. 4C. It will be noted that the frictional force exerted by the spring 42 on the cam edge 37B of the arming lever 37 functions as hereinbefore described.

Figure 4D:
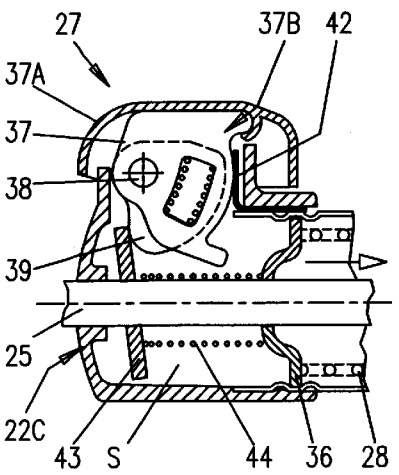
FIG. 4D is a view similar to FIG. 4C illustrating the parts in the armed position as the piston rod is initiating its retracting motion toward a door closing position.
Figure 4E:
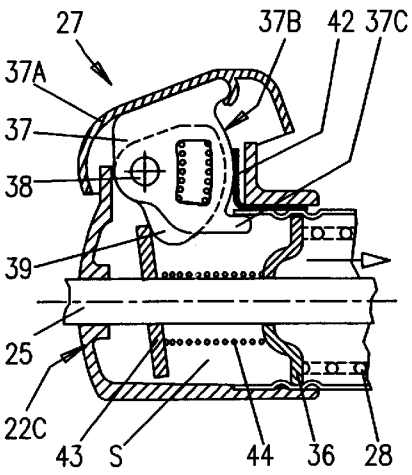
FIG. 4E is a view similar to FIG. 4D illustrating the parts in intermediate latching position and resetting the arming mechanism to the unarmed position.
Figure 4F:
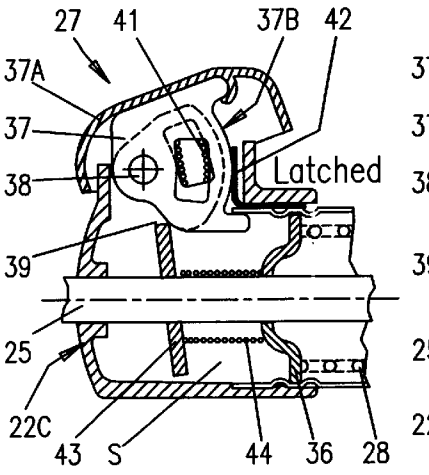
FIG. 4F is a side view similar to FIG. 4E illustrating the parts in the fully latched position.

With the door closer 20 thus armed, the piston rod 25, in extending to the left toward the door opening position as indicated in FIG. 4C, causes the latching washer 43 and the recoil spring 44, riding with the piston rod 25, to shift toward the end wall 22C. When the door is released, the compression spring 28 tending to bias the piston 30 to the right, as indicated in FIG. 4D, causes the latching washer 43 to shift slightly to the right. In doing so, the latching washer 43 effects contact with the trigger 39 to initiate the cantering of the latching washer 43, as shown in FIG. 4D. In doing so, the recoil spring 44, now confined between the latching washer 43 and the partition wall 36, begins to compress as the force of the compression spring 28 is causing the piston rod 25 to retract, i.e. move to the right as indicated by the arrow in FIG. 4D. As the force of the compression spring 28 acting as the piston 30 tends to retract the piston rod 25, the engagement of the cantered latching washer 43 on the trigger 39 and the associated arming lever 37 causes the arming lever 37 and associated trigger 39, which are still acting in unison, to be returned to its unarmed position, as best seen in FIG. 4E. This is effected because the force of the compression spring 28 is greater than the frictional force exerted by spring 42 acting on the arming lever 37. It will be noted that in the position shown in FIG. 4E, the arming lever is provided with an abutment stop 37C which engages the cylinder and limits the pivoting of the arming lever 37. As the rotation of the arming lever 37 about its pivot 38 is limited by the abutment stop 37C, the force of the compression spring 28, causing the piston rod 25 to retract further, causes the latching washer 43 riding thereon to cause the trigger 39 to now rotate independently of the arming lever 37 in a counterclockwise direction about pivot 38 to further compress spring 41. As best seen in FIG. 4F, the trigger 39 is displaced relative to the arming lever 37 to prevent any further shifting of the latching washer 43 to the right. In this position, the latching washer 43 fully arrests the piston rod 25 from retracting any further into the cylinder and the door is fully latched in the opened position. In the latched position as seen in FIG. 4F, the recoil spring 44 is compressed to exert a bias on the latching washer 43, as the latching washer 43 is arresting the piston rod 25. The motion of the trigger 39 relative to the arming lever 37 to effect the compression of spring 41 functions to absorb any shock imparted on the closer and to reduce any possibility of the door unlatching by any after or reverse shocking imparted by the door.

Figure 4G:
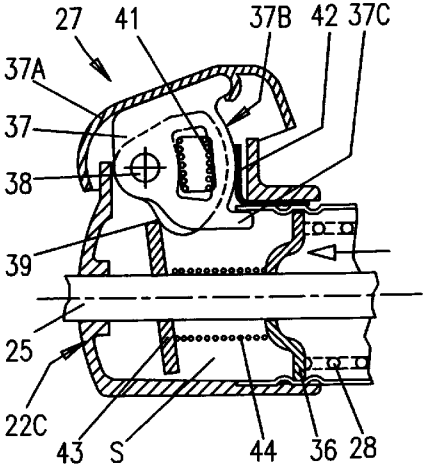
FIG. 4G is a side view similar to FIG. 4F illustrating the parts upon the initial displacement of the door toward the opening direction to effect the unlatching of the door closer and allowing the door to be moved to its closed position.

With the door latched in the opening position, as best seen in FIG. 4F, the door can be subsequently readily closed simply by imparting a slight force in the door toward the opening position slightly as indicated by the arrow in FIG. 4G. By extending the piston rod 25 slightly to the left as shown in FIG. 4G, the latching washer is shifted to the left. After the trigger 39 reaches its fully extended position, the reaction force on the latching washer 43 disappears and it unlatches and the recoil spring 44 pushes the latching washer 43 to assume an unlatching position as shown in FIG. 4B; thereby permitting the piston rod 25 to retract into the cylinder to close the door. It will be noted that upon the closing of the door, the arming mechanism 27 described is in a reset position and ready to be again armed at the will of the operator.

From the foregoing description, it will be apparent that the door closer described permits the closer to optimally function either as a conventional closer during an opening and closing position or which may be optionally armed to effect automatic latching of the door in the opened position in a simple and expedient manner.

Figure 5B:
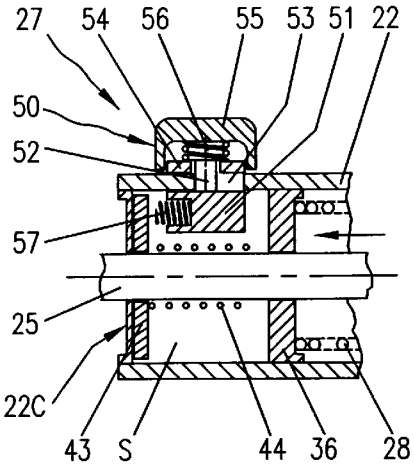
FIG. 5B is a view similar to FIG. 5 but illustrating the parts in an armed position.
Figure 5A:
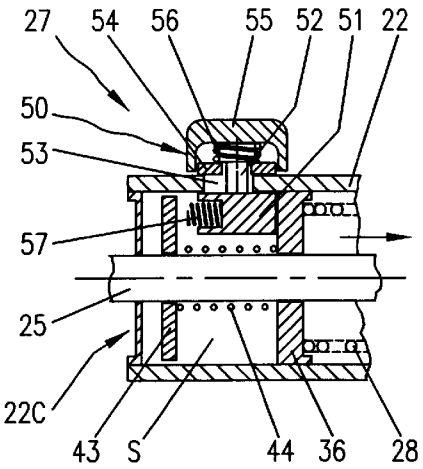
FIG. 5A is a view similar to FIG. 5 but illustrating the parts in an unarmed position with the piston rod being retracted to a door closing position.
Figure 5:
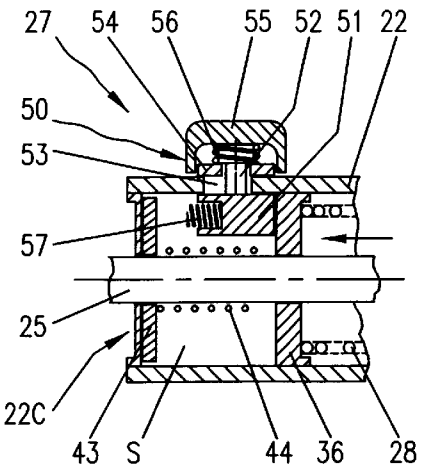
FIG. 5 is a fragmentary side view of a modified arming mechanism for use in a door closer of FIG. 2, illustrating the parts in an unarmed position as the piston rod is extended toward a door opening position.
Figure 5E:
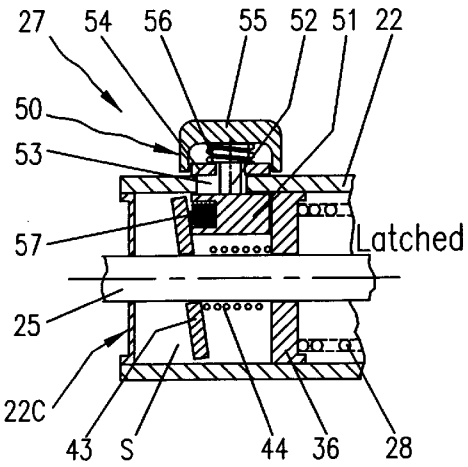
FIG. 5E is a view similar to FIG. 5D wherein the door closer is illustrated in the fully latched position.

FIGS. 5 to 5E illustrate another embodiment of the invention. In this form of the invention, the arming mechanism 27 is shown as a slide 50 as will be hereinafter described. In all other respects, the other components of the door closer are the same as previously described and referenced by the same reference numbers previously used in describing the embodiment of FIG. 4.

As shown in FIG. 5, the arming slide 50 comprises a slide body 51 which is disposed within the space S. A stem 52 connected to the slide body 51 projects upwardly through an elongated slot 53 formed in the cylinder 22 and a bearing washer 54. Connected to the free end of the slide body stem 52 is a button cap 55. A compression spring 56 disposed about the stem 52 between the button cap 55 and bearing washer 54 exerts a frictional force on the slide body 51 to maintain the slide body in frictional sliding relationship relative to the cylinder 22. The arrangement of the arming slide 50 is such that it is rendered slidable relative to the cylinder within the limits of slot 53 between an armed position and an unarmed position as will be herein described.

To minimize any shock being imparted on the closer by a rapid closing of the door, a dampening spring 57 may be provided on the arming slide body 51 or on the latching washer 43. As shown in FIG. 5, the dampening spring 57 is carried by the slide body 51.

The operation of the arming means of FIG. 5 is similar to that described with respect to the embodiment of FIG. 4 with the exception that the arming of the closer is effected by a sliding action. As shown in FIG. 5, the arming slide 50 is in the unarmed position and it is frictionally maintained in the unarmed position by the frictional force imparted by spring 56. With the arming slide 50 in the unarmed position, as seen in FIGS. 5 and 5A, the closer will function as a conventional door closer as hereinbefore described with respect to FIGS. 4A and 4B. As previously described, in the unarmed position the latching washer 43 and recoil spring 44 rides with the piston rod 25 as the piston rod 25 is extended in door opening position as seen in FIG. 5 and when retracting to a door closing position as seen in FIG. 5A without effecting the latching or arresting the piston rod 25.

Figure 5D:
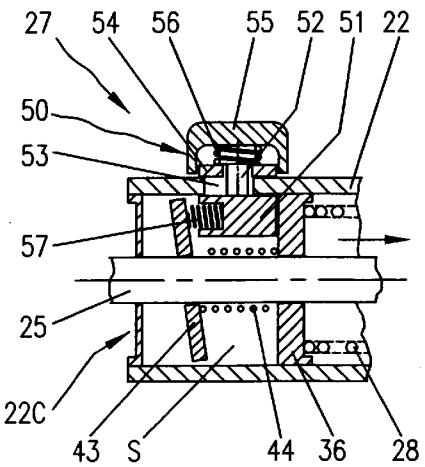
FIG. 5D is a view similar to FIG. 5C illustrating the parts in an intermediate latching position at the instant the arming mechanism is shifted or reset to an unarmed position.
Figure 5C:
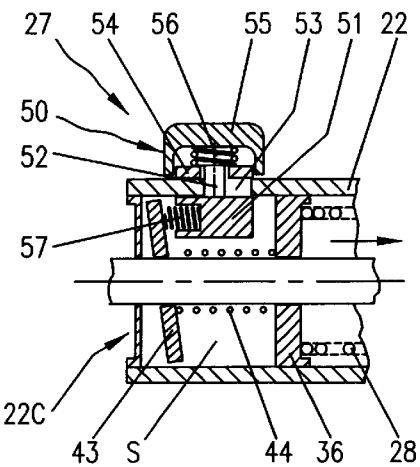
FIG. 5C is a view similar to FIG. 5 but illustrating the parts in an armed position as the piston rod moves toward a door closing position causing the latching washer to initially engage the arming mechanism.

FIG. 5B illustrates the arming slide 50 in the armed position with the piston rod 25 extending in the direction of the arrow to a door opening position. Upon release of the door after opening, the bias of the compression spring 28 acting on the piston 30 initiates the retraction of the piston rod 25. The latching washer 43 in retracting with the piston rod 25 as shown in FIG. 5C engages the dampening spring 54 which will cause the latching washer 43 to canter, at which instant it commences the compression the recoil spring 44. As the piston rod 25 continues to be biased toward closing position as seen in FIG. 5D, wherein the arming slide is shifted to its unarmed position. In doing so, the recoil spring 44 is further compressed. After the arming slide 50 is shifted to the unarmed position, the damper spring 57 is compressed until the piston rod 25 becomes fully latched as shown in FIG. 5E, to arrest the piston rod 25 from effecting the closing of the door.

The unlatching of the arming mechanism 27 of the embodiment of FIG. 5 is effected by slightly displacing the door toward its door opening position, causing the recoil spring 44 to effect the unlatching of the latching washer 43 to release the piston rod 25 to effect the closing of the door in a manner as hereinbefore described.

Figure 6:
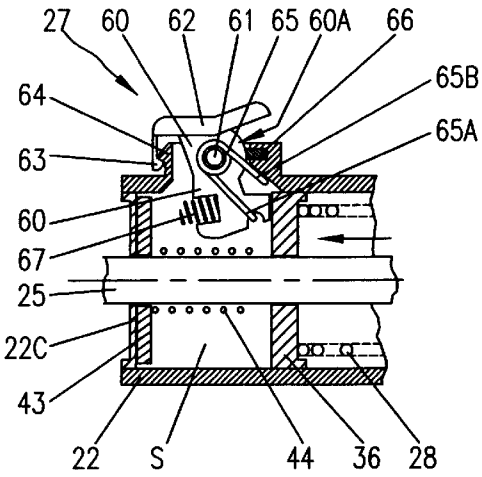
FIG. 6 is a fragmentary sectional side view of another modified form of the invention illustrating the position of the component parts in an unarmed position as the piston rod is being extended to an opening door position.

FIG. 6 illustrates another embodiment of the arming mechanism 27 for use in a door closer as herein described. In this form of the invention, the arming mechanism 27 comprises an arming lever 60 pivotally mounted about a pivot 61 mounted on the cylinder and extending into the space S between the partition wall 36 and the closer end wall 22C. Connected to the upper end of the arming lever 60 is a top or button 62 having a retaining means in the form of a spring latch or retaining hook 63 adapted to engage a complementary catch 64 on the cylinder 22. A pig tail spring 65 is looped about pivot 61 with one end 65A hooked to a notch formed on the lever 60 and having the other end 65B biased against the cylinder 22. The arrangement is such that the pig tail spring 65 normally biases the lever 60 toward the arming position. The arming lever 60 includes a cam edge 60A which is arranged to engage a suitable means, e.g. a spring, a felt bearing, screw or the like 66, to exert a frictional force or bias on the cam edge 60A. Connected to the lever 60 and projecting toward the latching washer 43 is a shock absorbing spring 67, arranged to engage the latching washer 43 when the arming lever 60 is in the arming position, as will be herein described.

Figure 6A:
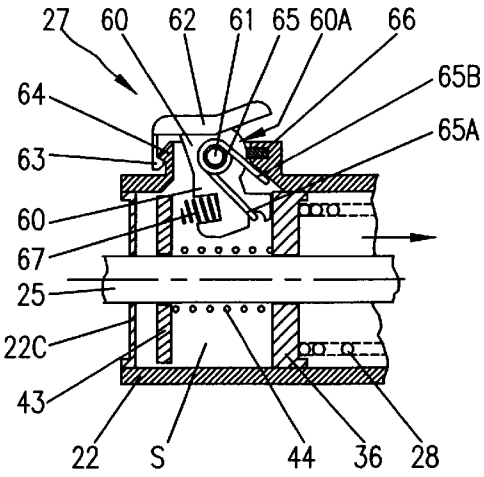
FIG. 6A is a view similar to FIG. 6 illustrating the parts in an unarmed position with the piston rod being retracted to a door closing position.

The operation of the closer of FIG. 6 is similar to that herein described. As seen in FIG. 6, the closer is illustrated in the unarmed position. In this position, the retainer or spring hook 63 in engagement with catch 64 maintains the arming lever 60 in the unarmed position and resists the force the pig tail spring 65 acting on the arming lever 60 tending to bias the lever 60 toward the armed position. In the unarmed position, as shown in FIG. 6 and with the piston rod 25 being extended in a door opening position as noted by the arrow, the latching washer 43 and the recoil spring 44 will ride with the piston rod toward the left. Upon releasing the door, with the arming lever 60 in the unarmed position, and with the piston rod 25 retracting into the cylinder as seen in FIG. 6A to close the door, the latching washer 43 and recoil spring 44 will ride on the piston rod without latching, as hereinbefore described. Thus, the closer, in the unarmed position, functions as a conventional closer.

Figure 6B:
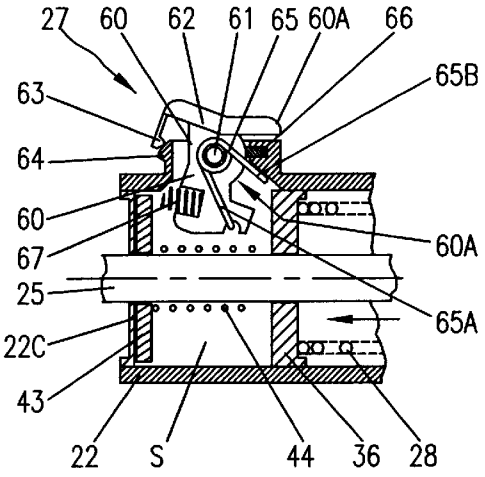
FIG. 6B is a view similar to FIG. 6 but illustrating the component parts in an armed position as the piston rod is being extended toward the door opening position.
Figure 6C:
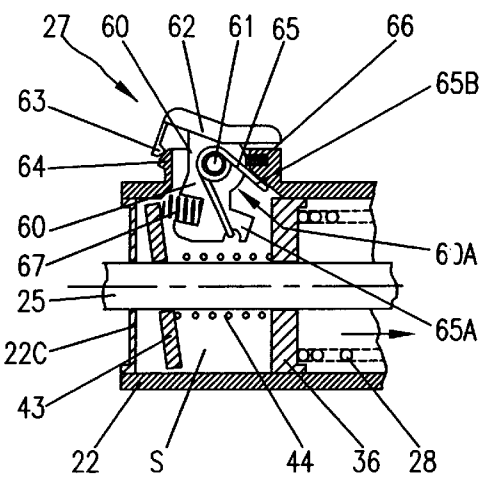
FIG. 6C is a view illustrating the component parts in the armed position showing the initial engagement of the latching washer with the arming mechanism during the initial retraction of the piston rod toward a door closing position.
Figure 6D:
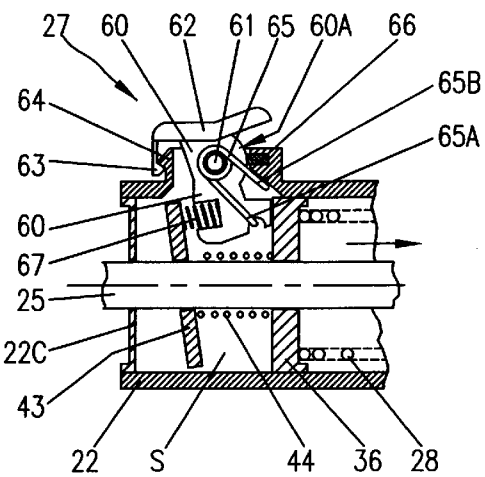
FIG. 6D is a view similar to FIG. 6C illustrating the parts in an intermediate position at the moment when the arming mechanism is reset to an unarmed position upon the retraction of the piston rod toward a door closing portion.
Figure 6E:
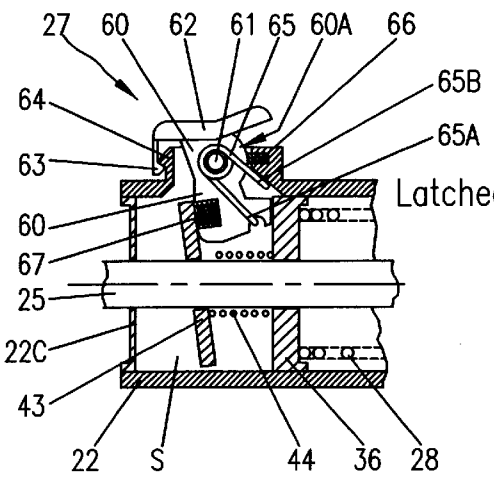
FIG. 6E is a view similar to FIG. 6D illustrating the components in a fully latched position.

To arm the closer of FIG. 6 to effect automatic latching of the door in the opened position, the user need only press the button 62 to disengage the spring hook 63 for its catch 64 as shown in FIG. 6B. Upon release of the spring hook 63, the compression of the pig tail spring 65 is released to rotate the lever 60 clockwise to decrease the distance between the arming lever and the latching washer 43. In the armed position of the lever 60, as shown in FIG. 6B and with the piston rod being extended to a door opening position, the latching washer 43 will ride to the left to engage the end wall 22C of the closer. Upon release of the door after opening, the piston rod 25 under the influence of the compression spring 28, will begin to move to the right as noted in FIG. 6C. In doing so, the latching washer 43, riding to the right with the retracting piston rod 25, engages the dampening spring 67 whereby the latching washer, begins to canter, the reaction force being provided by the pig tail spring 65 and/or the friction imparted by the means 66 are inherent to the operation of the component parts described. As the force of the compression spring 28 retracts the piston rod 25 a little more, the latching washer 43 riding with the piston rod 25 causes the arming lever to be reset to the unarmed position as noted in FIG. 6D, and causes further compression of the recoil spring 44 and the dampening spring 67, until the door is fully latched as shown in FIG. 6E. In the latched position, the piston rod 25 is fully arrested, thereby maintaining the associated door in the opened position.

To unlatch the latching washer 43 to release the piston rod 25 and permit the closing of the door, a slight displacement of the door toward the opening position is required, as hereinbefore described. This light movement of the door toward the open position will effect the latching washer 43, under the influence of the recoil spring 44 to unlatch, allowing the compression spring 28 to fully retract the piston rod 25 to effect the door closing.

From the foregoing, it will be apparent that the variously described embodiments can be optionally function as a door closer operative to open and close a door in a controlled unarresting manner or in an automatically latching or arresting mode at the will of the user. Further, the variously described arming mechanisms which permit the optional functionality of the door closer are relatively simple and positive in operation and can be readily actuated by the user, at will, even when the user's hands are occupied with bundles and the like.

While the present invention has been described with respect to particular embodiments, modifications and variations may be made without departing from the spirit or scope of this invention.

What is claimed is:

1. A door closer comprising:

a housing having an elongated cylinder forming a piston chamber, and a latching chamber axially disposed relative to said piston chamber, a piston reciprocally mounted within said piston chamber, a piston rod connected to said piston, a compression spring exerting a spring bias on said piston, said piston rod extending through said latching chamber, a latching member and an associated recoil spring loosely mounted on said piston rod within said latching chamber, and an arming device mounted on said housing and extending into said latching chamber, said arming device being readily shiftable between an armed position and an unarmed position, said arming device in the armed position being disposed to be engaged by said latching member to effect automatic actuation of said latching member to arrest the movement of said piston rod toward a door closing position.

2. A door closer as defined in claim 1 and including a means for exerting a bias on said arming device for maintaining said arming device in either the armed or unarmed position.

3. A door closer as defined in claim 1 and including a dampening means acting on said arming device to minimize any shocking imparted to the arming device upon the latching of the door.

4. A door closer as defined in claim 1 wherein said arming device comprises a lever pivotally connected to said housing.

5. A door closer as defined in claim 1 wherein said arming device comprises a slide slidably mounted on said housing.

6. A door closer as defined in claim 5 and including means acting on said slide for frictionally retaining said slide in either the armed or unarmed position.

7. A door closer as defined in claim 6 and including a dampening means connected to said slide to minimize any shocking during latching.

8. A door closer as defined in claim 1 and including means exerting a bias on said arming device for latching said arming device in the unarmed position.

9. A door closer as defined in claim 1 wherein said arming device includes:

a lever pivotally mounted on said housing and extending into said latching chamber between said latching member and said piston chamber, a trigger pivotally mounted for movement relative to said lever, and dampening means disposed between said lever and associated trigger to minimize any shocking imparted on the closure and to prevent any non-latching reactive force to occur during latching.

10. A door closer as defined in claim 9 wherein said lever and trigger each include a window that are disposed in alignment, and said dampening means includes a spring confined within said aligned windows for minimizing any shocking imparted on said arming device.

11. A door closer capable of being optionally operated to effect a normal opening and closing of a door and automatic latching of a door in an opening position at the will of a user comprising:

an elongated housing having opposed end walls, a partition wall disposed within said housing intermediate said end walls to define a piston chamber and a latching chamber, a piston reciprocally mounted within said piston chamber, a piston rod connected to said piston, said piston rod extending through said partition wall and adjacent latching chamber, a compression spring disposed within said piston chamber for maintaining a spring bias on said piston, a latching device and an associated recoil spring loosely mounted on said piston rod within said latching chamber, an arming device mounted on said housing and extending into said latching chamber, said arming device being shiftable between an arming position and an unarming position, and a means for exerting a bias on said arming device to maintain said arming device in either the armed or unarmed position.

12. A door closer as defined in claim 11 wherein said latching device includes a latching washer slidably mounted on said piston rod, whereby said latching washer is actuated by said arming device when in the armed position to effect the arresting of said piston rod in a door opened position.

13. A door closer as defined in claim 11 wherein said arming device includes means acting on said arming device for dampening any shocking occurring during latching and to prevent any unintentional non-latching due to any reactive reverse shocking.

14. A door closer as defined in claim 11 wherein said arming device includes a lever pivotally mounted on said housing and extending into said latching chamber for pivoting between an armed position and an unarmed position.

15. A door closer as defined in claim 14 and including a dampening means acting on said lever to minimize any shocking during latching.

16. A door closer as defined in claim 15 and including a trigger associated with said lever for pivoting therewith to the armed position and whereby said trigger pivots relative to said lever to effect the actuation of said latching device.

17. A door closer as defined in claim 16 and said dampening means including a dampening spring carried by said lever and trigger to absorb any shocking during latching of the door.

18. A door closer as defined in claim 17 and said lever including a camming surface, and said biasing means includes a spring bearing on said camming surface.

19. A door closer as defined in claim 11 wherein said housing includes a slotted opening to said latching chamber, and said arming device includes a slide having a slide body disposed within said latching chamber, a stem connected to said slide body projecting through said slotted opening, and a button cap connected to the extended end of said stem, and a biasing means including a spring disposed about said stem for exerting a bias on said slide for maintaining said slide in the armed or unarmed position, said slide being shiftable between an armed and unarmed position within said latching chamber.

20. A door closer as defined in claim 19 wherein said latching device comprises a latching washer slidably mounted on said piston rod between said partition wall and said associated recoil spring.

21. A door closer as defined in claim 20 and including a dampening means interposed between said slide body and said latching device.

22. A door closer as defined in claim 11 wherein said arming device comprises:

a lever pivotally mounted on said housing and extending into said latching chamber and shiftable between an armed position and an unarmed position, a spring for normally biasing said lever toward the armed position, means for resisting the force of said biasing spring for maintaining said lever in the unarmed position whereupon the release of said resistance means effects the shifting of said arming lever to the armed position.

23. A door closer as defined in claim 22 wherein said latching device comprises a latching washer slidably disposed on said piston rod between said recoil spring and the end wall of said latching chamber.

24. A door closer as defined in claim 23 and including a dampening means interposed between said lever and said latching device within said latching chamber.

25. A door closer as defined in claim 24 wherein said dampening means includes a spring carried on said lever disposed to be engaged by said latching device when said lever is in the armed position to absorb any shocking occurring during latching of the door and to prohibit any unintentional non-latching reactive force.

* * * * *